US005730022A

United States Patent [19]

Hansson et al.

[11] Patent Number: 5,730,022

[45] Date of Patent: Mar. 24, 1998

[54] TOOL HEAD

[75] Inventors: Mikael Hansson, Orsa; Mats Norin, Älvdalen; Göran Paulsson, Mora, all of Sweden

[73] Assignee: Pressmaster Tool AB, Alvdalen, Sweden

[21] Appl. No.: 616,635

[22] Filed: Mar. 15, 1996

[30] Foreign Application Priority Data

Mar. 22, 1995 [SE] Sweden ..... 9501024

[51] Int. Cl.[6] ..... B21J 9/18; B21D 7/06

[52] U.S. Cl. ..... 72/453.16; 72/409.14

[58] Field of Search ..... 72/429, 453.16, 72/453.15, 409.14

[56] References Cited

U.S. PATENT DOCUMENTS

| | | | |
|---|---|---|---|
| 2,897,703 | 8/1959 | Fischer et al. | 72/453.16 |
| 2,962,074 | 11/1960 | Dupre et al. | 72/453.16 |
| 4,475,374 | 10/1984 | Sakai et al. | 72/453.15 |
| 4,942,757 | 7/1990 | Pecora | 72/453.16 |

FOREIGN PATENT DOCUMENTS

| | | |
|---|---|---|
| 0 389 716 | 10/1990 | European Pat. Off. . |
| 0 531 897 | 3/1993 | European Pat. Off. . |
| 2 644 383 | 9/1990 | France . |
| 3835696 | 4/1990 | Germany . |
| WO95/14173 | 5/1995 | WIPO . |

*Primary Examiner*—David Jones

*Attorney, Agent, or Firm*—Jacobson, Price, Holman & Stern, PLLC

[57] ABSTRACT

A tool head comprising a fixed jaw (20), a movable jaw (21) journalled for movement towards and away from the fixed jaw, a pressure plunger-cylinder means (12–18) for driving the movable jaw, an electric control circuit (36–38, 40, 41, 51) for operating the plunger-cylinder means, and connecting means (52–55, 57) for connecting the plunger-cylinder means (12–18) and the control circuit to an electrical power and pressure-medium supply source separate from the tool head through the medium of a flexible conduit. The movable jaw (21) is guided for movement relative to the plunger-cylinder means (12–18) and is spring-biassed (22) from a retracted position in which it supports against the plunger-cylinder means towards an outwardly projected position in which it is located adjacent the fixed jaw (20). The movable jaw (21) is coordinated with means (25–27, 29, 31, 32, 35) which can be actuated manually outside the region of the jaws such as to move the movable jaw (21) away from the fixed jaw (20) against the action of the biassing spring (22).

11 Claims, 3 Drawing Sheets

19
11
20
46
47
21
41
35
40
16
14
22
18
17
12
51
15
10
59
13
53
II
II
54
56
52
57
58
51
50

56
12
56
54
53
52
55

TOOL HEAD

BACKGROUND OF THE INVENTION

1. Field of the Invention

The present invention relates to a tool head of the kind which includes a fixed jaw, a jaw which is journalled for movement towards and away from said fixed jaw, a pressure plunger-cylinder means for driving the movable jaw, said jaw being arranged to be pressed against the fixed jaw by said means during a tool-working cycle, an electric control circuit for operating the plunger-cylinder means and coupling means for connecting the plunger-cylinder means and the control circuit to an electric power and pressure-medium supply source separate from the tool head through the medium of a flexible conduit.

2. Description of the Related Art

In the case of portable but relatively heavy hydraulically operated clipping and/or crimping tools, for instance tools for crimping contacts or splicing devices onto the ends of large-diameter cables, it is known to divide the tool into two parts, namely a relatively light tool head which includes the crimping jaws and the plunger-cylinder means which drives the jaws, and a separate, relatively heavy electric-power and pressure-medium supply source, which is connected to the tool head through the medium of a flexible conduit. When the tool is in use, the electric-power and pressure-medium source can be placed on the ground or carried by the user with the aid of a shoulder strap, so as to leave the user's hands free to handle only the tool head and the cable components. Examples of earlier proposed solutions according to the preamble of claim 1 are disclosed in DE-A-3835696 and PCT/SE94/00966.

SUMMARY OF THE INVENTION

The object of the present invention is to provide a novel and advantageous tool head for use with a supply source of electric power and pressure-medium and which is considerably improved from a handling and safety aspect.

To this end, there is proposed a tool of the kind defined in the introduction in which the movable jaw is guided for movement in relation to the plunger-cylinder means and is spring-biassed from a retracted position in which it supports against the plunger-cylinder means towards a projected position in which it lies adjacent the fixed jaw, wherein the movable jaw is coordinated with a jaw-shifting device which can be actuated manually outside the jaw region so as to move the movable jaw away from the fixed jaw against the action of said biassing spring force. This arrangement effectively minimizes the risk of accidents when using the tool, since the jaws will always abut one another or with the object to be worked located therebetween, in the absence of any clearance therebetween except at the precise moment when the jaws are intentionally and deliberately separated by means of the jaw-shifting device.

Further characteristic features of the invention and advantages afforded thereby will be apparent from the dependent claims and also from the following description of an exemplifying embodiment of the novel tool head made with reference to the accompanying schematic drawings.

DESCRIPTION OF THE PREFERRED EMBODIMENT

Figure 1:
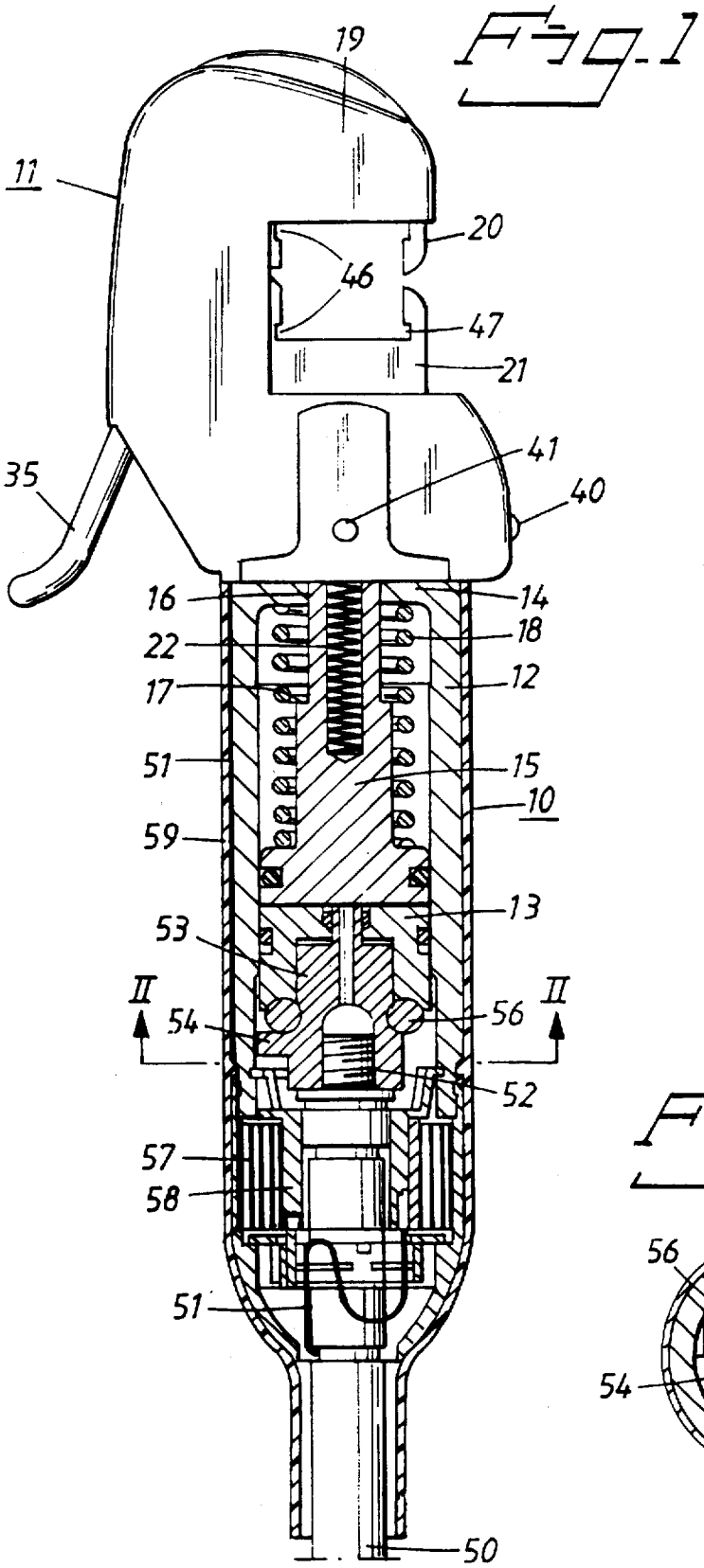
FIG. 1 is an axial section view and a partial side view of the tool head of the present invention.

The illustrated tool head includes a bottom part 10 which is configured as a hand grip, and a top or jaw-holder part 11 connected to the bottom part 10. The bottom part 10 houses a cylinder-plunger pressure means comprising a cylinder 12 having a rear cylinder wall 13 provided with a pressure medium inlet and outlet, and a front cylinder wall 14, and a plunger 15 mounted in the cylinder 12 and having a plunger rod 16 which passes through the cylinder wall 14. The plunger 15 and plunger rod 16 are movable between a retracted position shown in the drawings, and a forwardly or inwardly projected position (not shown), in which a shoulder 17 on the plunger 15 abuts the inside of the cylinder wall 14. The plunger 15 is biassed towards its retracted position by means of a pressure spring 18.

The jaw holder part 11 is comprised of a body 19 which in side view has a generally C-shape (FIG. 1) and in which two jaws 20, 21 are mounted. Each of the jaws is constructed in a known manner to receive an exchangeable jaw insert, so as to enable the tool head to be adapted for different working operations simply by exchanging jaw inserts. The jaw inserts of the jaws 20, 21 have not been shown in the drawings for the sake of clarity. The jaw 20 is fixedly mounted in the body 19, whereas the other jaw 21 is movable and can be urged by the pressure-exerting plunger-cylinder means 12–18 towards the fixed jaw 20 in a tool-working cycle. The movable jaw 21 is guided for movement in relation to the plunger-cylinder means and is biassed by means of a spring 22 from a retracted position in which it supports against the plunger-cylinder means 12–18 towards an outwardly projected position (FIGS. 3 and 5) in which it lies adjacent the fixed jaw 20. In the illustrated embodiment, the movable jaw 21 is mounted to this end on a pin 23 which is guided for axial movement in an axial blind bore 24 in the plunger rod 16, wherein the spring 22 is a pressure spring placed in the bore 24 between the bottom of the blind bore and the free end of the pin 23. This arrangement avoids the occurrence of clearance between the jaws 20, 21, and therewith eliminates the risk of injury due to unintentional insertion of fingers between the jaws.

Figure 3:
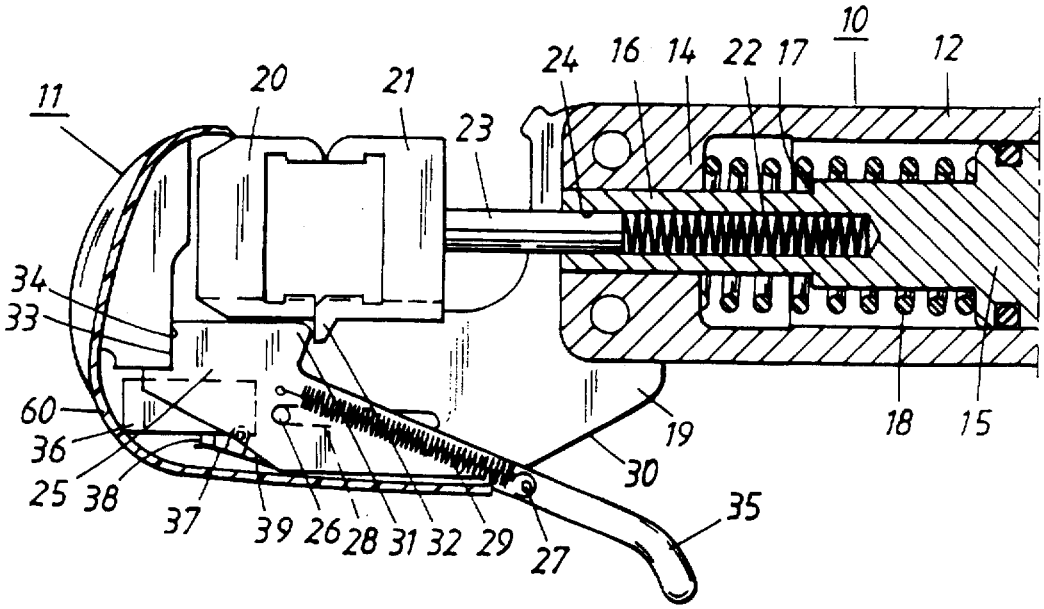
FIG. 3 is a longitudinal sectional view of an upper part of the tool head with the jaw holder shown in a section plane which is located closer to the viewer than the section plane through the plunger-cylinder device, the tool head being shown in a working position with the movable jaw outwardly projected and the jaw-shifting means in its starting position.
Figure 4:
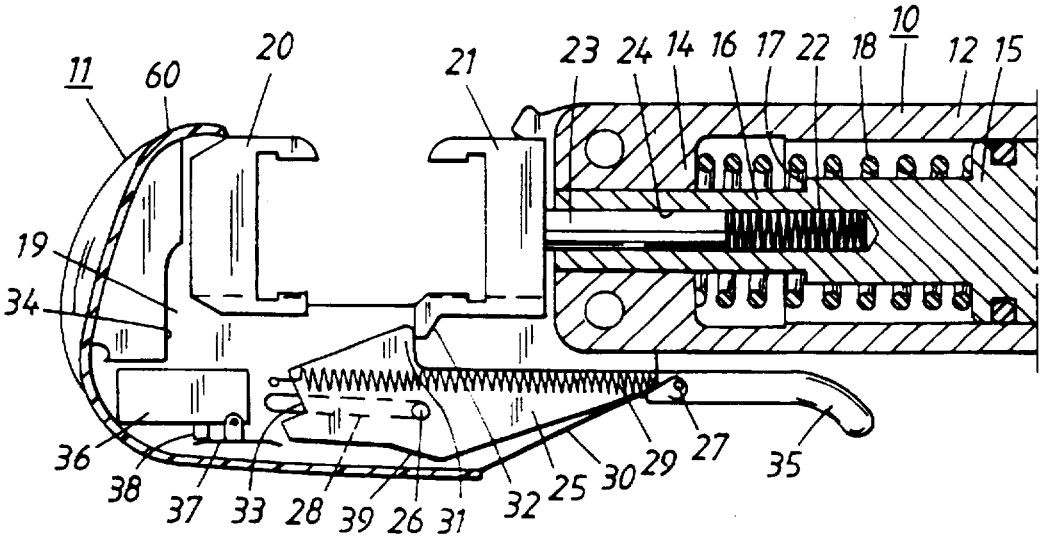
FIG. 4 is a view similar to the view shown in FIG. 3 but with the movable jaw of the tool head retracted.

As will be best seen from FIGS. 3 and 4, the jaws 20, 21 are parted by means of a jaw-shifting device which includes a plate-like element 25 which, in the illustrated case, has two transversely extending pins 26, 27, of which one pin 26 is received in a slot 28 in the body 19 and the other pin 27 lies constantly in abutment with a camming surface 30 on the body 19, under the action of a pull spring 29 acting between the pin 27 and a fixed point on said body. The plate-like element 25 also includes a shoulder 31 for coaction with a projection 32 provided on the movable jaw 21, and an abutment surface 33 for coaction with a stop abutment 34 on the body 19. The pin 27 has fixedly connected thereto a lever 35 by means of which the plate-like element 25 can be moved on the one hand between the starting position shown in FIG. 3, in which the pull spring 29 holds the abutment surface 33 pressed against the stop abutment 34 and the shoulder 31 is out of engagement with the projection 32 on the movable jaw 21 in abutment with the fixed jaw 20, and the pin 26 is located adjacent the end of the slot 28 distal from the lever 35, and on the other hand the retracted position shown in FIG. 4, in which the pin 27 has been moved rearwardly and inwardly along the camming surface 30 to the vicinity of the cylinder 12 by virtue of turning the lever 35 in a counter-clockwise direction as shown in FIG. 4, and the shoulder 31 has moved back the movable jaw 21 by virtue of engagement with the projection 32, and the pin 26 is located in the end of the slot 28 proximal to the lever 35. The object to be worked can be inserted between the jaws 20, 21 in the jaw shifted position shown in FIG. 4, wherein the jaw 21 is pressed against the jaw 20 via said object by the spring 22, immediately engagement between the shoulder 31 and the projection 32 ceases as the jaw-shifting means returns to its starting position. In the illustrated case, said means is returned automatically under the action of the pull spring 29.

The tool head also includes an electronic control circuit for operating the plunger-cylinder device. The circuit includes a control element which, in the illustrated case, has the form of a microswitch 36 having an electric contact element 38 that can be actuated by means of a pivotal actuator 37. The actuator 37 is shown in an inactive state in FIG. 4, wherein the electrical contact element 38 is also inactive and the microswitch switch 36 breaks the current through the electric control circuit and therewith make triggering of a tool-working cycle impossible. When the jaw-shifting means 25–27, 29, 31, 32, 35 reaches its starting position shown in FIG. 3, a camming part 39 provided on the plate-like element 25 activates the pivotal actuator 37, causing the actuator to pivot clockwise and depress the electric contact element 38. The microswitch 36 is therewith closed so that current is able to flow through the switch and so that a tool-working cycle can be triggered while the jaw-shifting means is located in said starting position. Thus, a tool-working cycle cannot be initiated as long as the jaw 21 is under the influence of the jaw-shifting means, which is highly advantageous feature of the tool head. A working cycle is initiated, or triggered, by depressing a start button 40 (FIG. 1), and can be stopped before the cycle has been fully completed, by depressing a stop button 41 shown in FIG. 1. The system is therewith able to operate advantageously in the manner described in PCT/SE94/00966 and will not therefore be described in more detail here, since it does not constitute part of the present invention.

The aforedescribed arrangement provides a high degree of safety against accidents while the tool head is in use, with the aid of simple means.

Figure 5:
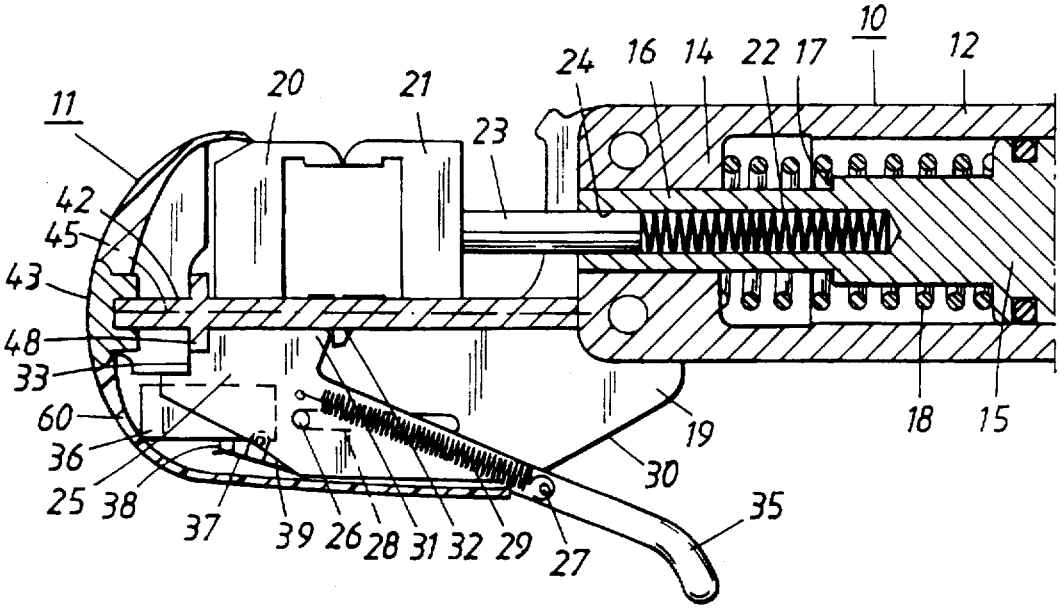
FIG. 5 is a central longitudinal sectional view of an upper part of the tool head and shows a jaw-locking means in its jaw-locking position.
Figure 6:
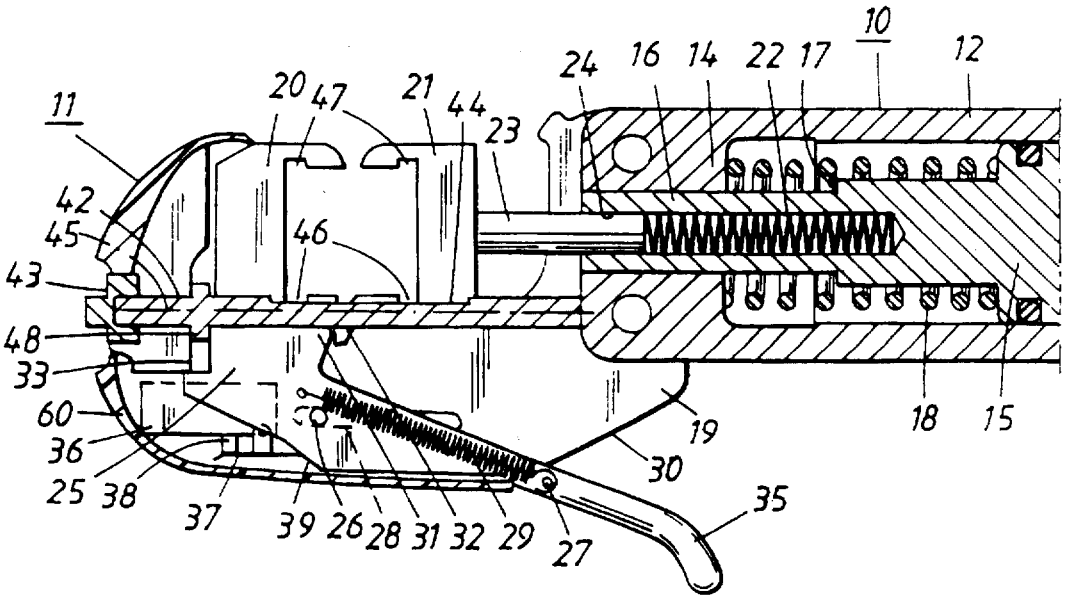
FIG. 6 is a view similar to the view shown in FIG. 5 but with the locking means in its jaw-releasing position.

The tool head is provided with exchangeable jaws or exchangeable jaw inserts in a known manner, and in order to minimize the risk of accidents when using the head, the head is appropriately provided with means which will prevent triggering of a tool-working cycle during a jaw change or a jaw insert change. An advantageous embodiment of one such arrangement is shown in FIGS. 5 and 6. The illustrated embodiment includes a cylindrical locking rod 42 which can be turned about its longitudinal axis by means of a knob 43 and which is provided along a section of its length with a recess 44 (FIG. 6) whose planar bottom is thus located closer to the locking rod axis 45 than the remaining parts of the locking rod 42 in said section or region. The jaws 20, 21 include dovetail grooves or undercuts 46, 47 which function to retain jaw inserts (not shown) which are intended for insertion into the jaws at right angles to the plane of the drawing and which have on the side thereof adjacent to the locking rod 42 shallow grooves with a cross-sectional shape corresponding to the shape of the material removed when forming the recess 44. When the rod 42 has the rotational position shown in FIG. 6, the bottom of the recess 44 will coincide with the undercuts 46, so as to enable the jaw inserts to be inserted freely into the jaws 20, 21. On the other hand, when the rod 42 is turned through about 90° to the position shown in FIG. 5, the rod 42 will fill-out the grooves formed in the inserts so as to hold the inserts in their inserted positions.

In order to prevent unintentional triggering of a working cycle when exchanging jaw inserts, for instance when changing one type of crimping jaw insert for another or when exchanging crimping jaws for clipping jaws, the rod 42 is provided with a flange-like part 48 which has a greater radial extension in directions parallel with the bottom of the recess 44 than in directions perpendicular to said bottom, as will be apparent from a comparison between FIGS. 5 and 6. The plate-like element 25 laterally spaced from the rod 42 is able to take its starting position, best seen in FIG. 3, without being obstructed by the flange-like part 48 when the rod is turned to the position shown in FIG. 5, therewith enabling a tool-working cycle to be initiated or triggered. However, rotation of the rod 42 through 90° from the position shown in FIG. 5 to the jaw insert release position is prevented by the element 25, which must therefore first be drawn back with the aid of the lever 35 to an extent which will enable the part 48 to swing in front of the abutment surface 33 on the plate-like element 25, in the manner shown in FIG. 6. However, the camming surface 39 will then no longer engage the pivotal actuator 37, which thus no longer depresses the electric contact element 38, therewith breaking the control circuit in the tool head so as to make triggering of a tool-working cycle impossible while the rod 42 is in the position in which a jaw insert change can be made.

Figure 2:
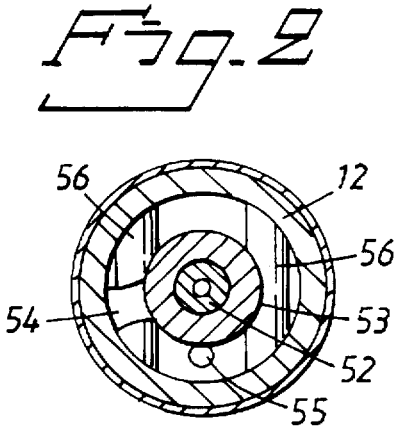
FIG. 2 is a cross-sectional view taken on the line II—II in FIG. 1.

The bottom end of the tool head, which is connected to an electric power and pressure medium supply source (not shown), preferably of the kind which is the subject of patent in the International Patent Application PCT/SE94/00966, is shown only in FIG. 1. Both electric power and pressure medium are thus supplied to the tool head through the conduit 50, wherein the power supply lines enter at 51 peripherally in relation to the centrally disposed pressure medium line which is connected at 52 to a connector piece 53 in which there is formed an axial passageway for the delivery and exhaust of pressure medium, in particular hydraulic fluid, to and from the space respectively beneath the plunger 15 in the cylinder 12. The connector piece 53 can be turned about its longitudinal axis and is sealingly mounted in a through-penetrating opening in the cylinder wall 13 and includes a radial arm 54 (see also FIG. 2) for engagement with a stop abutment 55 which is stationary relative to the cylinder 12 and which limits the extent to which the connector piece 53 can be turned relative to the cylinder wall 13 and therewith limits the extent to which the tool head can be turned relative to the conductor 50 to an angle of less than 360°. Reference numeral 56 identifies cylindrical transverse pins whose ends are received in corresponding bores in the cylinder 12 and which support the cylinder wall 13 and are received in a necked region in the connector piece 53, which is thus retained axially by the pins.

The electric power supply lines 51 are fastened adhesively to a relatively long strip 57 inside the tool part 10, with the strip loosely wound around a reel 58 that can be rotated together with the conduit 50, to which the innermost turn of the strip 57 is firmly connected. The outermost turn of the coiled strip is stationary in relation to the cylinder 12. Because the strip is coiled loosely, the tool head can be turned through at least one revolution in relation to the conduit 50 without damaging the lines 51, which when leaving the coiled strip 57 extend upwards along the outer surface of the cylinder 12 to the various electric components 25, 40, 41 of the jaw holder part 11. The power supply lines 51 are protected by outer protective casings 59, 60, suitably plastic casings, on the lower part 10 and on the jaw holder part 11 respectively.

It will be understood that the invention is not restricted to the aforedescribed and illustrated exemplifying embodiments thereof and that the concept of the invention can be realized in any suitable manner within the scope of the invention as defined in the following claims.

We claim:

1. A tool head comprising a fixed jaw (20), a movable jaw (21) journaled for movement towards and away from said fixed jaw, a pressure plunger-cylinder means (12–18) for driving said movable jaw, said movable jaw being urged by said plunger-cylinder means towards said fixed jaw (20) in a tool working cycle, an electrical control circuit (36–38, 40, 41, 51) for operating said plunger-cylinder means (12–18), and connecting means (52–55, 57) for connecting said plunger-cylinder means (12–18) and said control circuit to an electrical power and pressure-medium supply source separate from said tool head, said movable jaw (21) being guided for movement relative to said plunger-cylinder means (12–18) and being spring-biased (22) from a retracted position adjacent said plunger-cylinder means towards an outwardly extended position adjacent said fixed jaw (20), and a manually actuated jaw-shifting means (25–27, 29, 31, 32, 35) to move said movable jaw (21) away from said fixed jaw (20) against the action of said biasing spring (22), said jaw-shifting means being movable to and spring biased (29) in a direction towards a starting position in which said movable jaw (21) is left free, and when said tool head is in said starting position, said jaw-shifting means (25–27, 29, 31, 32, 35) actuates and resets a control element (36–38) included in said control circuit (36–38, 40, 41, 51) to enable a tool-working cycle to be triggered.

2. A tool head according to claim 1, and further comprising exchangeable jaws or jaw-inserts and means (42–45, 48) on said tool head for preventing triggering of said tool-working cycle during a jaw or jaw-insert change.

3. A tool head according to claim 2, wherein said preventing means (42–45, 48) include a latching member (48) insertable into a path of movement of said jaw-shifting means between the starting position and a jaw engaging position to prevent said jaw-shifting means from taking the starting position during a jaw or jaw insert change.

4. A tool head according to claim 3 and further comprising a locking means (42–45) associated with said latching member (48) to lock exchangeable jaws or jaw-inserts in said tool head, said latching member (48) engaging the jaw-shifting means (25–27, 29, 31, 32, 35) when said locking means is in a jaw or jaw-insert releasing position so as to prevent movement of said jaw-shifting means, and said latching member (48) is to be out of preventive engagement with said jaw-shifting means when said locking means is in a jaw or jaw-insert locking position.

5. A tool head according to claim 1, wherein said connector means (52–55, 57) enables the tool head (10, 11) to be rotated relative to a flexible conduit (50) for supplying said pressure medium to said tool head.

6. A tool head according to claim 5, wherein said connector means (52–55, 57) includes means (54, 55) for limiting rotation of said tool head relative to the flexible conduit (50), and supply lines (51) connecting said tool head to the electric supply source forming a coil (57) in the region of the connection between the conduit (50) and said tool head, said coil (57) having loosely coiled turns to permit limited rotation of said tool head (10, 11) relative to the conduit (50).

7. A tool head comprising a body having a fixed jaw and a movable jaw mounted on said body for movement of said movable jaw toward and away from said fixed jaw, a pressure driven piston for driving said movable jaw toward said fixed jaw in a tool driving operation, a biasing spring independent of said pressure driven piston to dispose said movable jaw toward said fixed jaw, a jaw-shifting mechanism on said body and engageable with said movable jaw to move said movable jaw away from said fixed jaw to a retracted position, a control circuit for controlling a power source for said pressure driven piston, said control circuit including an activation control on said tool head to act with said jaw shifting mechanism to permit activation of said power source when said jaw-shifting mechanism is unengaged with said movable jaw and disposed to permit said movable jaw to extend fully toward said fixed jaw.

8. A tool head as described in claim 7 and further comprising a latching member on said body to engage said jaw-shifting mechanism to prevent said jaw-shifting mechanism from permitting said movable jaw to extend fully toward said fixed jaw.

9. A tool head as described in claim 8, wherein said latching member includes a locking mechanism to permit an exchange of jaws or jaw-inserts in said tool head, said mechanism permitting removal and insertion of jaws or jaw-inserts when said latching member engages said jaw-shifting mechanism and preventing removal or insertion of jaws or jaw-inserts when said latching member is unengaged with said jaw-shifting mechanism.

10. A tool head as described in claim 7 and further comprising a tension spring to act on said jaw-shifting mechanism to dispose such at a starting position where said jaw-shifting mechanism will engage said activation control to permit activation of said power source.

11. A tool head as described in claim 7 and further comprising a rotatable connection of a conduit to said tool head, said conduit providing pressure medium to said pressure driven piston and providing an electrical communication between said control circuit and said power source through electrical wiring, said electrical wiring connected to a strip loosely wound to form a coil in said tool head, one end of which is securedly attached at the outermost winding of said coil to said tool head and the other end of said strip at the innermost winding of said coil is attached to said conduit to permit rotation of said tool head in relation to said conduit.

* * * * *